US009248848B2

(12) United States Patent
Hogan

(10) Patent No.: US 9,248,848 B2
(45) Date of Patent: Feb. 2, 2016

(54) WIRELESS AND/OR WIRED FREQUENCY PROGRAMMABLE TERMINATION SHUNTS

(71) Applicant: Siemens Industry, Inc., Alpharetta, GA (US)

(72) Inventor: Brian Hogan, Temecula, CA (US)

(73) Assignee: SIEMENS INDUSTRY, INC., Alpharetta, GA (US)

( * ) Notice: Subject to any disclaimer, the term of this patent is extended or adjusted under 35 U.S.C. 154(b) by 284 days.

(21) Appl. No.: 13/836,459

(22) Filed: Mar. 15, 2013

(65) Prior Publication Data

US 2014/0263858 A1 Sep. 18, 2014

(51) Int. Cl.

| | |
|---|---|
| ***B61L 1/00*** | (2006.01) |
| ***B61L 1/18*** | (2006.01) |
| ***B61L 29/22*** | (2006.01) |

(52) U.S. Cl.

CPC ..... *B61L 1/187* (2013.01); *B61L 29/226* (2013.01)

(58) Field of Classification Search

CPC ..... B61L 1/187; B61L 1/185; B61L 1/186; B61L 1/181; B61L 29/222; B61L 29/224; B61L 29/226

See application file for complete search history.

(56) References Cited

U.S. PATENT DOCUMENTS

| | | | | |
|---|---|---|---|---|
| 4,949,084 | A * | 8/1990 | Schwartz et al. | 340/2.2 |
| 5,029,780 | A * | 7/1991 | Peel | 246/127 |
| 5,464,176 | A * | 11/1995 | Kruse | 246/126 |
| 7,315,770 | B2 * | 1/2008 | Wade et al. | 701/19 |
| 8,500,071 | B2 * | 8/2013 | O'Dell | 246/293 |
| 8,590,844 | B2 * | 11/2013 | Hogan | 246/34 B |
| 8,857,769 | B1 * | 10/2014 | Hogan | 246/122 R |
| 2004/0181321 | A1 * | 9/2004 | Fries et al. | 701/19 |
| 2014/0263858 | A1 * | 9/2014 | Hogan | 246/125 |
| 2014/0319286 | A1 * | 10/2014 | Hogan | 246/122 R |

FOREIGN PATENT DOCUMENTS

| | | | |
|---|---|---|---|
| CN | 101301896 | B | 4/2011 |
| DE | 3010707 | A1 | 9/1981 |
| FR | 2504879 | A1 | 11/1982 |
| JP | 2004148863 | A | 5/2004 |

OTHER PUBLICATIONS

PCT International Search Report mailed Nov. 6, 2014 corresponding to PCT International Application No. PCT/US2014/027800 filed Mar. 14, 2014 (11 pages).

* cited by examiner

*Primary Examiner* — Jason C Smith

(57) ABSTRACT

A programmable frequency termination shunt suitable to terminate a portion of a railroad track circuit. The programmable frequency termination shunt includes a multi-frequency shunt circuit having a plurality of selectable shunt frequencies and a processor coupled to the multi-frequency shunt circuit. The processor is adapted to set the termination frequency of the shunt by selecting one of the shunt frequencies of the multi-frequency shunt circuit. The shunt is powered by signals transmitted along the rails of the railroad track and can be programmed in response to signals from a rail-based communication link or a wireless communication link.

9 Claims, 2 Drawing Sheets

WIRELESS AND/OR WIRED FREQUENCY PROGRAMMABLE TERMINATION SHUNTS

BACKGROUND

A crossing predictor (often referred to as a grade crossing predictor in the U.S. or a level crossing predictor in the U.K.) is an electronic device that is connected to the rails of a railroad track and is configured to detect the presence of an approaching train and determine its speed and distance from a crossing (i.e., a location at which the tracks cross a road, sidewalk or other surface used by moving objects), and use this information to generate a constant warning time signal for controlling a crossing warning device. A crossing warning device is a device that warns of the approach of a train at a crossing, examples of which include crossing gate arms (e.g., the familiar black and white striped wooden arms often found at highway grade crossings to warn motorists of an approaching train), crossing lights (such as the red flashing lights often found at highway grade crossings in conjunction with the crossing gate arms discussed above), and/or crossing hells or other audio alarm devices. Crossing predictors are often (but not always) configured to activate the crossing warning device at a fixed time (e.g., 30 seconds) prior to an approaching train arriving at a crossing.

Typical crossing predictors include a transmitter that transmits a signal over a circuit formed by the track's rails and one or more termination shunts positioned at desired approach distances from the transmitter, a receiver that detects one or more resulting signal characteristics, and a logic circuit such as a microprocessor or hardwired logic that detects the presence of a train and determines its speed and distance from the crossing. The approach distance depends on the maximum allowable speed of a train, the desired warning time, and a safety factor. Preferred embodiments of crossing predictors generate and transmit a constant current AC signal on said track circuit; the crossing predictor detects a train and determines its distance and speed by measuring impedance changes caused by the train's wheels and axles acting as a shunt across the rails, which effectively shortens the length (and hence the impedance) of the rails in the circuit.

To prevent the signals transmitted by one crossing predictor from interfering with another crossing predictor, crossing predictors are often configured to transmit on different frequencies. Hence, crossing predictors use frequency specific termination shunts to define their approach length. These termination shunts are set to a fixed frequency (i.e., the termination frequency) to match the frequency of the crossing predictor, but the shunts may be equipped with switches and/or jumpers to allow their termination frequency to be manually changed in the field if need be. These shunts, however, are typically buried or located in wayside enclosures some distance (e.g., 3,000 feet) away from the crossing predictor equipment. Thus, changing the termination frequency of the shunts can be difficult and time consuming, thereby slowing rail and vehicle traffic during the changing process, and would require an undesirable amount of man-power to complete. There is, therefore, a need and desire for a better mechanism for changing the termination frequency of an installed termination shunt.

DETAILED DESCRIPTION OF SEVERAL EMBODIMENTS

Figure 1:
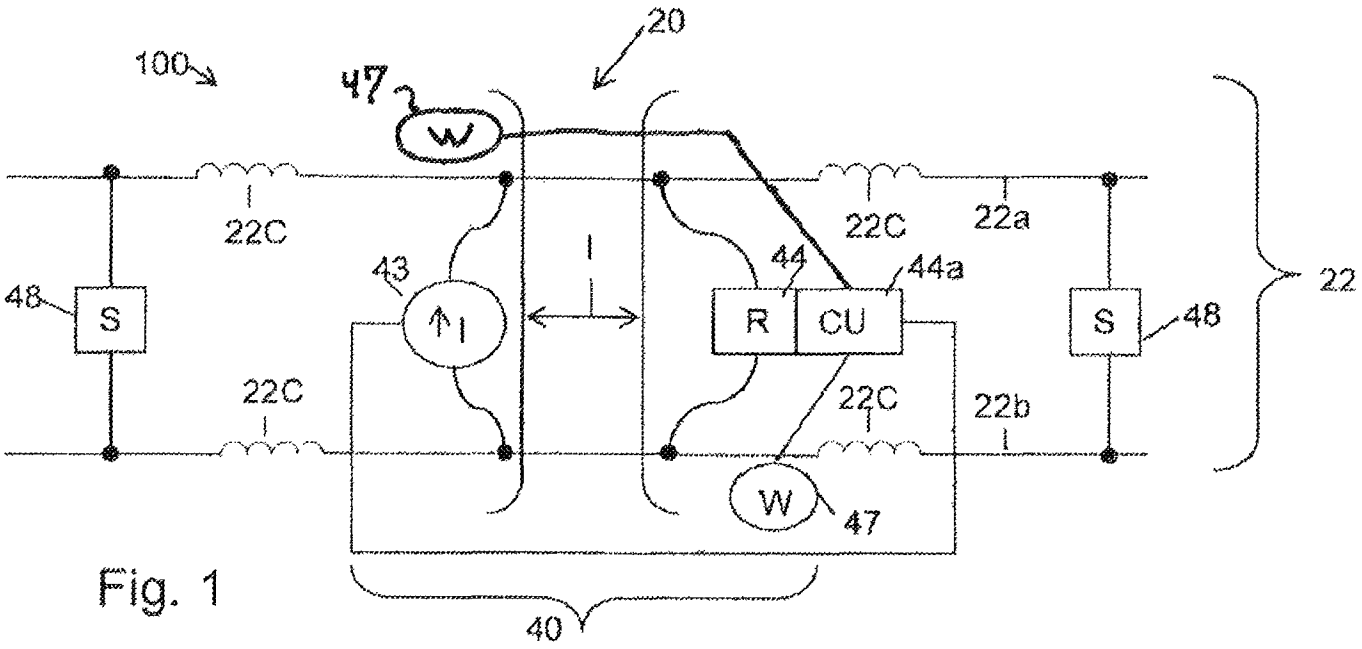
FIG. 1 is a circuit diagram of a known crossing predictor.

FIG. 1 illustrates a typical prior art crossing predictor circuit 100 at a location in which a road 20 crosses a railroad track 22. The railroad track 22 includes two rails 22*a*, 22*b* and a plurality of ties (not shown in FIG. 1) that support the rails. The rails 22*a*, 22*b* are shown as including inductors 22*c*. The inductors 22*c*, however, are not separate physical devices but rather are shown to illustrate the inherent distributed inductance of the rails 22*a*, 22*b*. A crossing predictor 40 comprises a transmitter 43 connected across the rails 22*a*, 22*b* on one side of the road 20 and a receiver 44 connected across the rails 22*a*, 22*b* on the other side of the road 20. Although the transmitter 43 and receiver 44 are connected on opposite sides of the road 20, those of skill in the are will recognize that the components of the transmitter 43 and receiver 44 other than the physical conductors that connect to the track 22 are often co-located in an enclosure located on one side of the road 20. The transmitter 43 and receiver 44 are also connected to a control unit 44*a*, which is also often located in the aforementioned enclosure. The control unit 44*a* is connected to and includes logic for controlling warning devices 47 at the crossing of the road 20 and the track 22. The control unit 44*a* also includes logic (which may be implemented in hardware, software, or a combination thereof) for calculating train speed and constant warning time signals for its crossing.

Also shown in FIG. 1 are a pair of termination shunts 48, one on each side of the road 20 at a desired approach distance. The shunts 48 may be simple conductors, but are typically tuned circuit AC circuits configured to shunt the particular frequency being transmitted by the transmitter 43. An example of a frequency selectable shunt is disclosed in U.S. Pat. No. 5,029,780, the entire contents of which are hereby incorporated herein by reference. The transmitter 43 is configured to transmit a constant current AC signal at a particular frequency, typically in the audio frequency range, such as 50 Hz-1000 Hz. The receiver 44 measures the voltage across the rails 22*a*, 22*b*, which (because the transmitter 43 generates a constant current) is indicative of the impedance and hence the inductance of the circuit formed by the rails 22*a*, 22*b* and shunts 48.

If a train heading toward the road 20 crosses one of the shunts 48, the train's wheels and axles act as shunts, essentially shortening the length of the rails 22*a*, 22*b*, thereby lowering the inductance, impedance and voltage measured by the control unit 44*a*. Measuring the change in the impedance indicates the distance of the train, and measuring the rate of change of the impedance (or integrating the impedance over time) allows the speed of the train to be determined. As a train moves toward the road 20 from either direction, the impedance of the circuit will decrease, whereas the impedance will increase as the train moves away from the receiver 44/transmitter 43 toward the shunts 48.

Figure 2:
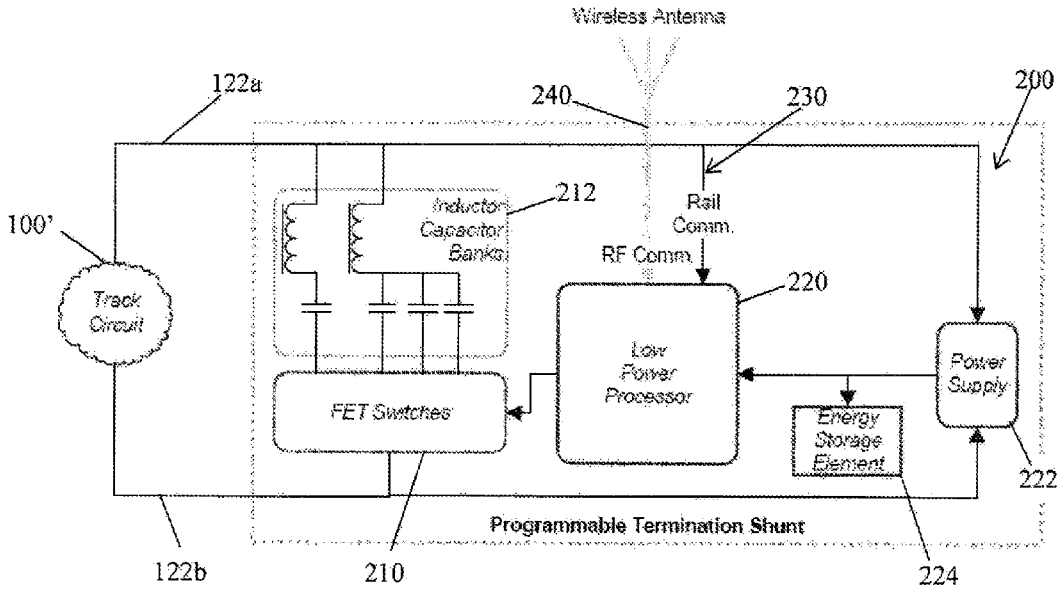
FIG. 2 is a circuit diagram of a rail powered programmable frequency shunt according to an embodiment of the invention.

There are times when the termination frequency of the shunts 48 may need to be changed (explained in more detail below). As mentioned above, current techniques are costly and/or time consuming. In accordance with an embodiment disclosed herein, FIG. 2 illustrates a circuit diagram of a rail-powered programmable frequency shunt 200 (also referred to herein as "termination shunt 200") that can have its termination frequency changed in an easy, advantageous and desirable manner. The shunt 200 serves as a termination shunt for a railroad track circuit 100'. Track circuit 100 is similar to the crossing predictor circuit 100 illustrated in FIG. 1 with the exception that one or both of the shunts 48 illustrated in FIG. 1 are replaced by the programmable termination shunt 200 of FIG. 2. The termination shunt 200 includes a switch circuit 210 and a multi-frequency shunt circuit 212 comprised of a plurality of banks of inductor-capacitor circuit branches. It should be appreciated that while FIG. 2 illustrates two banks of inductor-capacitor circuit branches, the disclosed embodiments should not be so limited as any number of banks, inductor-capacitor branches, inductive elements or capacitive elements may be used.

The switch circuit 210 and the multi-frequency shunt circuit 212 are connected in series across connections 122*a*, 122*b* that are respectively connected to the rails 22*a*, 22*b* (FIG. 1) of the track circuit 100'. FIG. 2 shows the switches as being field-effect transistor (FET) type switches, but it should be appreciated that other types of controllable switches can be used. As is explained below in more detail, the switches within the switch circuit 210 can be set to select one of a plurality of frequencies defined by the inductor-capacitor circuit branches in circuit 212 (i.e., one or more inductor-capacitor circuit branches of circuit 212 will be connected to the rails 22*a*, 22*b* via connections 122*a*, 122*b* and one or more switches in circuit 210). The inductance and capacitance of the selected inductor-capacitor circuit branch or branches define the desired termination frequency of the shunt 200 that will be used by the crossing predictor 40 within the track circuit 100' to detect the presence of a train and to determine its speed and distance from the crossing, and to control warning devices 47 as appropriate. It should be appreciated that the inductors shown in circuit 212 could be separate inductive components or they could be the inductance of a portion of a rail or connection to the rails 22*a*, 22*b*.

The termination shunt 200 also includes a low-power processor 220 or other suitable controller, which is powered by a power supply 222. In one embodiment, the processor 220 is coupled to receive termination frequency programming information signals via rail communications 230 (i.e., signals are transmitted over the rails 22*a*, 22*b* (FIG. 1) of the railroad track 20 and through connections 122*a*, 122*b*). Those skilled in the art can appreciate that signals corresponding to coded information, and not just signals indicative of track impedance, can be transmitted over railroad track rails. That is, information can be coded or transmitted as signals over the rails using certain frequencies or modulation techniques such that the information can be detected and processed by a processor (e.g., processor 220) or other controller connected to the rails. One such technique is disclosed in U.S. Patent Application Publication 2011/0011985. Desirably, the rail communications 230 can be initiated from a transmitter or other device located within the equipment bungalow often located at the crossing. It should be appreciated that the disclosed embodiment is not limited to the exact form of rail communications and that any type of communication scheme that involves passing information in signals transmitted over railroad track rails can be used.

The termination frequency programming information signals received via the rail communications 230 will be used by the processor 220 to control the switches in circuit 210. The processor 220 will parse out the programming information, whether by signal value, level, frequency, etc. and use the information to access a data structure, look-up table, hardware registers, or other suitable logic to retrieve the appropriate code/message to send to circuit 210 to control the switches therein. The received termination frequency programming information signals could include a code or signal level corresponding to a specific termination frequency value, an inductance and/or capacitance value for circuit 212, a switch setting for circuit 210, or any other indication that can be interpreted and used by the processor to set the switches to select the inductance and capacitance of circuit 212, which combine to achieve the desired termination frequency. As mentioned above, the switches will be set to select the appropriate inductor-capacitor circuit branch or branches whose combined inductance and capacitance produces the desired termination frequency for the shunt 200. In one embodiment, the switch circuit 210 includes logic or some type of demultiplexing function that can receive a signal or code from the processor 220 and determine which switches to activate based on the received signal or code. The activated switches connect the appropriate inductor-capacitor circuit branch or branches to the track circuit 100' via the connections 122*a*, 122*b* to the rails 22*a*, 22*b*. In one desired embodiment, the processor 220 will include or be connected to a non-volatile memory storage device (e.g., FLASH memory) that on power-up (via availability of power from the rails) will set the switches based on the settings/information stored in the memory. In addition, the desired switch settings (or other information) will be stored in the non-volatile memory once it is received and decoded.

The processor 220 may also be adapted to receive wireless communications 240 (via an antenna or other suitable device) from a remote controller or other source. The wireless communications 240 can include the same type of termination frequency programming information discussed above (i.e., a specific termination frequency, an inductance and/or capacitance value, a switch setting, etc.) that allows the processor 220 to select the inductor-capacitor circuit branch or branches whose inductance and capacitance produces the desired termination frequency for the shunt 200. Desirably, the wireless communications 240 can be initiated from a transmitter or other device located within/near the equipment bungalow or from another area within transmission range. Thus, the shunt 200 can use rail communications 230 and/or wireless communications 240 as a communication link to program the switch settings within circuit 210 to achieve the desired termination frequency. The design of the shunt 200 allows it to conveniently change its termination frequency where the grade crossing predictor/warning equipment is located (i.e., by the crossing). The termination frequency can be changed quickly and without an undesirable amount of man-power since the change can be made without digging out buried shunts or traveling to wayside enclosures located away from the crossing predictor equipment. This means that the termination frequency of the shunt 200 can be reprogrammed as often as it is deemed necessary without suffering from the disadvantages of current systems.

The disclosed shunt 200 has other advantages. For example, the power for the termination shunt electronics is obtained from the rails 22*a*, 22*b*. That is, the power supply 222 and other components can be powered by the track impedance detection signals or the termination frequency programming signals transmitted over the rails 22*a*, 22*b* of the track circuit 100'. As can be appreciated, the power required by the switches and logic within the switch circuit 210 and multi-frequency shunt circuit 212 is minimal once the frequency of the shunt 200 is selected. In addition, or alternatively, the programmable termination shunt 200 can include an energy storage device 224 charged from the rails 22*a*, 22*b*. This allows the components of the shunt 200 to operate in a low power mode when rail power is unavailable (i.e., during rail shunting by a train). For example, the processor 220 and wireless communications 240 would remain powered despite no power along the rails 22*a*, 22*b*. The energy storage device 224 could be a short term storage device such as e.g., a super-capacitor or a rechargeable battery. The disclosed shunt 200 has the additional advantage of having a finite time required to power-up the shunt electronics. This means that the time required to make any change will be known and railroad personnel or maintenance workers can quickly follow to make sure the change was completed. Moreover, because the shunt 200 may also use wireless communications 240, a wireless indication of the programmed frequency may also be obtained and used by railroad or maintenance personnel to assess/maintain the configuration of installed crossing predictors in one or more locations.

The shunt 200 disclosed herein is particularly useful in the situation in which weather or other track conditions dictate that using a certain termination frequency would achieve better impedance detection results than other frequencies. Thus, a method of using the disclosed shunt 200 could include detecting a weather condition or other track condition, determining whether the current termination frequency should be changed in response to the detected weather condition or other track condition, and changing the termination frequency to a new termination frequency if it is determined that the termination frequency should be changed in response to the detected weather condition or other track condition.

The shunt 200 disclosed herein is also useful in situations in which the stray capacitance of a track circuit 100' changes over time. Changes can be made to ensure that the termination frequency remains suitable for impedance detection despite changes to the stray capacitance. Thus, a method of using the disclosed shunt 200 could include detecting that a stray capacitance of a track circuit has changed and changing the termination frequency to a new termination frequency if it is determined that the stray capacitance of the track circuit has changed. It should be appreciated that there is a general need for the temporal or dynamic changing of shunt frequency (as opposed to a static frequency) and that the use of the disclosed shunt 200 should not be limited to the scenarios described herein.

While various embodiments have been described above, it should be understood that they have been presented by way of example and not limitation. It will be apparent to persons skilled in the relevant art(s) that various changes in form and detail can be made therein without departing front the spirit and scope. In fact, after reading the above description, it will be apparent to one skilled in the relevant art(s) how to implement alternative embodiments. Thus, the present embodiments should not be limited by any of the above-described embodiments.

In addition, it should be understood that any figures which highlight the functionality and advantages are presented for example purposes only. The disclosed methodology and system are each sufficiently flexible and configurable such that they may be utilized in ways other than that shown.

Although the term "at least one" may often be used in the specification, claims and drawings, the terms "a", "an", "the", "said", etc. also signify "at least one" or "the at least one" in the specification, claims and drawings.

Finally, it is the applicant's intent that only claims that include the express language "means for" or "step for" be interpreted under 35 U.S.C. 112, paragraph 6. Claims that do not expressly include the phrase "means for" or "step for" are not to be interpreted under 35 U.S.C. 112, paragraph 6.

What is claimed is:

1. A programmable termination shunt comprising:

a multi-frequency shunt circuit comprising a plurality of selectable shunt frequencies defined by banks of inductor-capacitor circuit branches each having an associated inductance and capacitance;

a switching circuit connected to the multi-frequency shunt circuit; and a processor coupled to the multi-frequency shunt circuit via said switching circuit, said processor adapted to set a termination frequency of the shunt by selecting a switch setting within the switching circuit that selects one of said selectable shunt frequencies in the multi-frequency shunt circuit.

2. The programmable termination shunt of claim 1, wherein the multi-frequency shunt circuit is adapted to be coupled between rails of a railroad track and said processor is adapted to receive a termination frequency programming signal from at least one of the rails.

3. The programmable termination shunt of claim 2, wherein the termination frequency programming signal comprises a new termination frequency.

4. The programmable termination shunt of claim 2, wherein the termination frequency programming signal comprises a desired inductance and capacitance of said multi-frequency shunt circuit.

5. The programmable termination shunt of claim 2, wherein the termination frequency programming signal comprises a switch setting for the switching circuit.

6. The programmable termination shunt of claim 2, wherein said processor and said multi-frequency shunt circuit are powered by signals transmitted over the rails.

7. The programmable termination shunt of claim 6, wherein said shunt further comprises an energy storage element for storing power transmitted over the rails.

8. The programmable termination shunt of claim 1, wherein said processor is adapted to receive a termination frequency programming signal from a wireless communication link.

9. The programmable termination shunt of claim 8, wherein the termination frequency programming signal comprises one of a new termination frequency, a desired inductance and capacitance of components within said multi-frequency shunt circuit or a switch setting for said switching circuit.

* * * * *